United States Patent [19]

Singh

[11] 3,933,497

[45] Jan. 20, 1976

[54] PHOTOSENSITIVE AZIDO PROCESSES

[75] Inventor: Balwant Singh, Stamford, Conn.

[73] Assignee: American Cyanamid Company, Stamford, Conn.

[22] Filed: June 27, 1974

[21] Appl. No.: 483,483

Related U.S. Application Data

[60] Division of Ser. No. 313,378, Dec. 8, 1972, Pat. No. 3,844,793, which is a continuation-in-part of Ser. No. 82,129, Oct. 19, 1970, abandoned, which is a continuation-in-part of Ser. No. 29,527, March 17, 1970, abandoned.

[52] U.S. Cl. ..... 96/49; 96/27 R; 96/48 HD; 96/75; 96/90 R; 96/91 N; 260/349

[51] Int. Cl.[2] ... G03C 1/52; G03C 1/72; G03C 5/18

[58] Field of Search ..... 96/49.75, 91 D, 48 HD, 96/90 PC, 90 R, 27 R; 260/349; 250/316, 317; 117/36.8, 36.9

[56] References Cited

UNITED STATES PATENTS

| | | | |
|---|---|---|---|
| 1,845,989 | 2/1932 | Schmidt et al. | 96/91 N |
| 2,692,826 | 10/1954 | Neugebauer et al. | 96/91 N |
| 3,072,485 | 1/1963 | Reynolds et al. | 96/91 N X |
| 3,092,494 | 6/1963 | Sus et al. | 96/91 N X |
| 3,100,702 | 8/1963 | Rauner et al. | 96/91 N X |
| 3,282,693 | 11/1966 | Sagura et al. | 96/91 N X |
| 3,287,128 | 11/1966 | Lugasch | 96/91 N X |
| 3,519,425 | 7/1970 | Marshall et al. | 96/91 N |
| 3,598,586 | 10/1971 | Gaspar | 96/91 N X |
| 3,660,093 | 5/1972 | Ranz et al. | 96/91 N X |
| 3,699,130 | 10/1972 | Singh | 96/91 N X |
| 3,748,135 | 7/1973 | Singh | 96/91 N |
| 3,752,671 | 8/1973 | Singh | 96/91 N |
| 3,844,793 | 10/1974 | Singh | 96/91 N |

OTHER PUBLICATIONS

Hoffman et al., J. Chem. Soc. C., 1969, pp. 769–772.

Anon, Research Disclosures, 11/1971, pp. 98–100.

Kosar, J., "Light-Sensitive Systems," 1965, pp. 276–280 and 330–336.

*Primary Examiner*—Charles L. Bowers, Jr.

*Attorney, Agent, or Firm*—H. G. Jackson

[57] ABSTRACT

Dry photoimaging processes and compositions employing photosensitive coatings of volatile peri-substituted aromatic azido compounds in a permeable film-forming plastic are disclosed.

9 Claims, No Drawings

PHOTOSENSITIVE AZIDO PROCESSES

This is a division, of application Ser. No. 313,378 filed Dec. 8, 1972, now Pat. No. 3,844,793.

This application is a division of application Ser. No. 313,378 filed Dec. 8, 1972 now U.S. Pat. No. 3,844,793, which is a continuation-in-part of my copending application for letters Pat., Ser. No. 82,129 filed Oct. 19, 1970 which is a continuation-in-part of my Ser. No. 29,527 filed Mar. 17, 1970 both applications now abandoned.

This invention relates to unique photosensitive compositions containing volatile peri-substituted aromatic azido compounds. It further relates to dry processes for the formation of thermally fixed non-vesicular images therefrom. It further relates to imaging processes and photosensitive compositions employing certain peri-substituted aromatic azido compounds. It further realtes to the intensification and modification of the images produced from said peri-substituted aromatic azido compounds.

Photosensitive compounds, compositions and processes play an essential role in photography and related arts dealing with the formation of images with the aid of some activating influence, such as light, heat, etc. Among the currently available methods of image formation, several problems are typically encountered. Costly materials, such as silver salts, are often required. Liquid solutions of chemicals are often required in the fixing or development stages of the imaging process, causing both inconvenience and delay. Many photochemicals require excessive access time and result in poor image quality from such factors as poor color stability, poor speed, acuity, resolution, tonal range, etc. Accordingly, a new photoimaging process which would overcome one or more of these limitations would provide a substantial advance in the art.

The sensitivity of aromatic azido compounds to ultraviolet light and their use in photoimaging is well known in the photographic arts, see, for example, U.S. Pat. Nos. 1,845,989, 3,096,311 and 3,282,693. However, such processes are limited to those involving one or more wet steps in the formation of a light stable image; and, typically, suffer from one or more of the other aforementioned disadvantages.

Accordingly, objects of the present invention are to provide novel photosensitive compositions and dry imaging processes substantially overcoming one or more of the aforementioned prior art limitations.

In accordance with the present invention, it has been unexpectedly found that volatile peri-substituted aromatic azido compounds are particularly well adapted for the formation of fixed images by a convenient dry imaging process. Furthermore, it has been unexpectedly found that the image colors are modified by heating the fixed image prepared from certain peri-substituted aromatic azido compounds or by exposing them to ultraviolet radiation.

VOLATILE PERI-SUBSTITUTED AROMATIC AZIDO COMPOUNDS

Certain volatile peri-substituted aromatic azido compounds are preferred for use in the present invention due to the fact that the images produced on exposure can be intensified and fixed by heating. The fixed images can be modified to neutral tones by further heating or exposure to ultraviolet light. The resulting images having the advantage of enhanced contrast with a colorless or white background for easier reading and the aesthetic advantage of having purple, blue and neutral tones resembling conventional printing and writing inks.

The volatile, peri-substituted aromatic azido compounds have a substituent selected from the group consisting of: azido, hydroxy, trifluoroacetamido, amine and

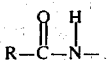

wherein R is lower alkyl as defined below. Otherwise, they may be substituted and characterized as the aromatic azido compounds, as mentioned below. The azido group may be represented as —N,. It is believed to have resonance structures represented as follows: $-N^{\ominus}-N^{\oplus} \equiv N \rightleftharpoons -N=N^{\oplus}=N^{\ominus}$. Peri-substituted aromatic azido compound is defined as a naphthalene having an azido substituent in the 1 or 8 position and located peri to one of the five groups mentioned above. The 1,8-disubstituted-naphthalenes, such as, 1,8-diazidonaphthalene, 1-acetamido-8-azidonaphthalene, 1-amino-8-azidonaphthalene, 1-azido-8-trifluoroacetamidonaphthalene and 1-azido-8-hydroxynapththalene are especially preferred due to their ease of preparation and the developing and fixing achievable therewith.

Non-volatile aromatic azido compounds are not suitable for use in the present invention. As used herein, the expression "non-volatile compounds" refers to those compounds which decompose at temperatures below that at which they volatilize from the photosensitive compositions. Accordingly, high molecular weight compounds, such as, polymeric aromatic azido compounds, and aromatic compounds having substituents, such as, carboxylic acid salts, are unsuitable for use in the present invention.

In general, any of the wide variety of standard procedures for preparing aromatic azido compounds may be employed to prepare the photosensitive compounds employed in the present invention, such as, for example, those described in U.S. Pat No. 3,123,621 or in Houben-Weyl, Methoden Der Organischen Chemie, Band 10/3, pp. 777–836 and references cited therein.

Among the numerous and diverse suitable substituents, the following are among the preferred: lower alkyl groups having from 1 to 6 carbon atoms, such as, methyl, ethyl, *n*-propyl, iso-propyl, *n*-butyl, *t*-butyl, *n*-pentyl, *n*-hexyl, cyclohexyl, etc.; lower alkoxy groups having from 1 to 6 carbon atoms, such as, methoxy, ethoxy, *n*-propoxy, isopropoxy, *n*-butoxy, *t*-butoxy, *n*-pentoxy, *n*-hexoxy, cyclohexyloxy, etc.; amino, lower alkyl amino and di-lower alkyl amino, said lower alkyl groups being defined above;

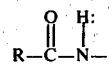

wherein R is lower alkyl as defined above or phenyl; trifluoroacetamido; and hydroxy.

Suitable aromatic azido compounds include, for example: azidonaphthalene compounds, such as 1,8-diazidonaphthalene, 1,8-diazido-2,7-dimethoxynaphthalene, 1,8-diazido-2,3-dimethoxynaphthalene, 1,8-diazido-4,5-dimethoxynaphthalene, 2,3,4,5,6-heptamethyl-1,8-diazidonaphthalene, and 1,4,5,8-tetraazidonaphthalene.

PHOTOSENSITIVE COMPOSITIONS

The photosensitive compositions of the present invention are prepared by uniformly distributing a layer of the volatile, aromatic azido compound in a conventional binder, such as, a polymer dope, over the surface of a conventional photographic substrate.

Suitable substrates include, for example, such materials as paper, plastic, wood, metal and glass.

Suitable binders include, for example, one or more of the following polyvinyl chloride, polyethylene, polymethylmethacrylate, polyvinyl acetate, cellulose acetate and copolymers of the corresponding monomers. Polyvinyl chloride is especially preferred.

Any of the variety of standard coating methods can be used to apply the coating composition to the base material. The Fixed Blade Method, the Imbibing Method and the Meyer Rod Method are among the preferred techniques.

In the Fixed Blade Method, the base material is positioned under a fixed blade and an excess of the coating material is placed on the base. The base is then passed under the blade to produce a uniform coating having a thickness determined by the distance between the mounted blade and the base material.

In the Imbibing Method, a base stock having a plastic surface is coated with the active compound by passing it under a roller, through a solution of the azido compound. The excess coating is removed from the surface by an air knife. By way of illustration, one may mention passing paper coated with polyvinyl chloride, polyvinyl acetate or polymethylmethacrylate through a solution of 1,8-diazidonaphthalene in a solvent such as tetrahydrofuran, methyl ethyl ketone, acetone or toluene or mixtures thereof.

In the Meyer Rod Method, the coating composition is placed at one end of the base material and a metal rod wound with fine wire is passed through the liquid causing it to be spread over the surface of the base material. The thickness of the coating produced by this method is determined by the size of the wire used in the winding.

The concentrations of azido compound advantageously employed in the coating compositions and the thickness of the layer applied to the base may be varied to tailor the photosensitive system to achieve the desired degree of image intensity, speed, length of fixing period, etc. Optimum concentrations and thicknesses will, of course, vary depending on the particular photosensitive compound employed, the binder material and thickness of the binder layer used, fixing time and temperature, among other factors. In general, satisfactory photoimages can be produced using binder compositions having from about 3 to about 15 percent by weight of the azido compound with coatings of from about 0.05 to about 1.00 mils in thickness, Preferred concentrations and thicknesses are about 15% and 0.3 mils, respectively.

Background colorup is generally minimized by selecting azido compounds of maximum thermal stability and volatility and binders of maximum permeability to azido compounds, applied in minimum thicknesses. Generally, background colorup and diffusion time increase exponentially with film thickness. However, they are relatively unaffected by increases in the concentration of the azido compounds. The relationship between binder thickness and the time required for 90% removal of the 1,8-diazidonaphthalene (DAN) from polyvinyl chloride (Geon-101 by B. F. Goodrich Chemicals Co.) on a polyester film (Mylar by E. I. DuPont deNemours & Co.) as shown in Table I.

TABLE I

| Conc. of DAN Normality | Binder Thickness mil | Time (min.) |
|---|---|---|
| .1 | 0.14 | 1.5 |
| .1 | 0.33 | 5.5 |
| .7 | 0.14 | 1.5 |
| .7 | 0.33 | 5.5 |

The aromatic azido compounds are themselves generally sensitive to radiation containing wavelengths within the ultraviolet region. By means of the addition of a sensitizing agent to the polymer binder, the sensitivity can be extended into the range of from 360 mμ to 470 mμ or greater. The energy transfer of such systems is surprisingly efficient in view of the typically high viscosity of the binder polymer systems being sensitized.

Several advantages are provided by the use of sensitized systems. They permit the use of apparatus equipped with inexpensive and convenient light sources, such as incandescent lamps, and allow projection printing through various optical systems with normal optical glass. They also permit the simultaneous use of both direct and indirect excitation of azido compounds through simultaneous exposure of the photosensitive compounds to both visible and ultraviolet light. Alternatively, enhanced absorption can be achieved by using an ultraviolet absorbing sensitizer in combination with the azido composition.

Suitable sensitizers include, for example, fluoranthene, thioxanthone, fluorenone, perylene, benzanthrone, benzophenone, phenazine and thioacridone.

Sensitizers which absorb light in the visible spectrum are of necessity colored compounds. Where the colors caused thereby are found to be objectionable, it is preferred to employ unsensitized systems or compositions containing a colorless, ultraviolet absorbing sensitizer or a member of a class of volatile, colored sensitizers which diffuse out of the binder composition during the fixing or image modification steps. Illustrative of the preferred, volatile colored sensitizers are fluorenone and benzanthrone.

Optimum concentrations of the sensitizer and azido compound will, of course, vary with the particular system being employed. Generally, energy transfer is favored by high concentrations of the azido compound. It is preferred to employ the sensitizer in a sufficient concentration to absorb the incident light. However, excessively high concentrations of the sensitizer will cause complete absorption of the incident light at the surface of the plastic matrix and may thereby reduce the efficiency of the system.

IMAGING

Non-vesicular imaging is achieved by exposing the photosensitive compositions to patterned activating radiation, namely, an information containing beam of visible or ultraviolet light.

A convenient source of ultraviolet radiation is provided by lamps which emit a wide range of ultraviolet frequencies. A light table equipped with a film transparency (positive or negative) and a bank of ultraviolet-rich blacklight fluorescent lamps, such as, 15 watt Black Light, No. F15T8-BL by General Electric and Rayonet Photochemical Reactor Lamps, No. RPR 3000A by The Southern New England Ultraviolet Company provides a convenient source of activating radiation. Convential azo printing machines, equipped with high pressure mercury vapor lamps may also be employed. Since they emit both visible and ultraviolet light, they are especially well adapted for use with those compositions having sensitizers to visible light.

Absorption of incident light can be maximized by matching the frequencies of the incident light with the absorption frequencies of the aromatic azido compound or the sensitizer.

Patterning of the activating radiation can generally be achieved by any of the conventional methods. Suitable methods include passing the light through a film transparency or a template, use of a cathode ray tube containing an ultraviolet phosphor, such as, a Litton Industries' Cathode Ray Tube, Ser. No. 4188, which contains a P16 phosphor; and using an ultraviolet pen light, such as Ultraviolet Products, Inc. Pen-Light, or ultraviolet laser, such as might be used in spatial frequency modulation.

Optimum periods of irradiation will vary widely, depending upon the particular photosensitive composition, opacity of transparency, and light source employed. Exposure for a few seconds in a conventional azo printer is generally adequate while periods of two minutes or more may be required for a source such as the abovementioned light table.

DEVELOPING

The imaged compositions are developed by merely heating the exposed compositions. Optimum heating temperatures and periods will vary widely depending upon the compositions employed and the means by which heat is transferred. In the case of 1,8-diazidonaphthalene, oven temperatures in the range of from about 100°C. to about 150°C. are generally suitable and about 135°C. is generally preferred. At 150°C. developing is usually complete after about 20 seconds, whereas periods of up to about 7 minutes may be required for complete development at 135°C. Contact heating with a platen permits more rapid heating and reduces fixing time over that in an oven.

The peri-azido aromatic compounds unexpectedly undergo a 6 to 10 fold increase in the optical density measured at 560 m$\mu$ during development. The initially formed images are typically grey-green or brownish. After development, they generally appear deep purple. This image intensification is unique to the peri-substituted compounds. For example, 1,8-diazidonaphthalene initially forms a grey-green image which develops to a high optical density purple image; while positional isomers, such as 1,5-diazidonaphthalene, form tan or brown images with no substantial enhancement in optical density on heating at 200°C.

FIXING

The developed images are fixed by merely heating to effect volatilization of the unreacted aromatic azido compound. This is conveniently achieved by merely prolonging the period of heating used for development. Again the optimum temperature and heating period will vary upon the particular system employed. In the case of 1,8-diazidonaphthalene in polyvinyl chloride, permanent fixing can generally be achieved by heating the exposed compositions at 135°C. for a period of from about 1 to about 5 minutes.

MODIFICATION OF IMAGE COLOR

The fixed images prepared from the peri-azido aromatic compositions unexpectedly undergo modification in image color to neutral tones upon re-exposure to ultraviolet light or additional heating at higher temperatures.

In the case of modification by exposure to ultraviolet light, the process can be carried out over a wide variety of radiation frequencies. A high pressure mercury lamp is a convenient means for modifying these images. The optimum period of exposure will vary with the lamp employed, composition used and degree of modification desired.

In the case of thermal modification of the fixed images, again the time and temperature can be widely varied. Treatment for about 3 to 4 minutes at from about 190°C. to about 200°C. is generally sufficient to produce neutral images.

Preparation of various aromatic azido compounds and the processes and compositions of the invention are further illustrated by the following examples which are not to be taken as limitative thereof. All parts specified therein are by weight unless otherwise indicated.

EXAMPLE 1

Preparation of 1,8-Diazidonaphthalene

Into a three-necked 2 liter flask equipped with a mechanical stirrer, a low temperature thermometer and a dropping funnel were placed 1,8-diaminonaphthalene (31.6 g., 0.2 mole), 120 ml. of concentrated hydrochloric acid, 150 ml. of water and $NaBF_4$ (55.0 g., 0.5 mole). The suspension was vigorously stirred and cooled in a salt-ice bath to −20°C. A solution of $NaNO_2$ (30 g., 0.435 mole) in 60 ml. of water was added dropwise with vigorous stirring. The resulting bis-diazonium fluoroborate precipitated out of solution as a beige solid. It was removed by filtration, washed once with cold ether and converted to the diazide immediately.

The precipitated bis-diazonium salt was added in small portions with vigorous stirring to a cold solution composed of $NaN_3$ (30 g., 0.46 mole) dissolved in a mixture of 100 ml. of water and 100 g. of ice. The 1,8-diazidonaphthalene precipitated out of solution in the form of a thick paste. It was removed by filtration, washed with water and dissolved in diethyl ether. The ether solution was filtered through charcoal and the yellow mother liquor was concentrated whereupon the 1,8-diazidonaphthalene crystallized out of solution in the form of long, thin silky needles which were collected by filtration and air dried to give a 60 percent yield of 1,8-diazidonaphthalene having a melting point of 120°–122°C. Further purification may be effected by recrystallization from ether, methanol, ethanol or by chromatography on silica gel or alumina columns with a hexane eluent.

Analysis: Calcd. for $C_{10}H_6N_6$: C, 57,14; H, 2.88; N, 39.99; Found: C, 57.67; H, 2.84; N, 40.63 57.55 2.89 40.64

EXAMPLE 2

Preparation of 1-Amino-8-Azidonaphthalene

The compound was prepared by the rearrangement reactions of 1-aminonaphtho(1,8-de)triazene and 2-aminonaphtho(1,8-de)triazene [C. W. Rees and R. C. Storr, J. Chem. Soc. (C), 756 (1969); R. W. Hoffmann, G. Guhn, M. Freiss and D. Dittrich, ibid, 769 (1969)] which are obtained by the amination of naphtho(1,8-de)triazine [H. Waldmann and S. Back, *Ann.* 545, 52 (1940)]. The overall yield was 40 percent, m.p. 80°C–81°C., Lit. M.P. 80°C.

EXAMPLE 3

Preparation of 1-Acetamido-8-Azidonaphthalene

To a stirred solution of 8-azido-1-naphthylamine (1.84 g., 0.01 mole) in 70 ml. of pyridine was added a solution of acetyl chloride (0.784 g., 0.01 mole) in 10 ml. of ether. The mixture was warmed on a steam bath for 30 minutes. The solvents were removed in vacuo and the residue washed with water and dried. Recrystallization from hexane provided 1-acetamido-8-azidonaphthalene in the form of colorless, long needles having a yield of 2.1 g., 93 percent, m.p. 148°C.–149°C., Lit. m.p. 147°C.–148°C. and an analysis of: Calcd. for $C_{12}H_{10}N_4C$: C, 63.70; H, 4.46; N, 24.77 Found: C, 63.90; H, 4.14; N, 24.66

EXAMPLE 4

Preparation of 1-Azido-8-Trifluoracetamidonaphthalene

A sample of 8-azido-1-naphthylamine (192 mg., 1.04 mole) was treated at room temperature with 10 ml. of trifluoracetic anhydride. An exothermic reaction took place. The mixture was warmed at 40°C. for 10 minutes and then evaporated to dryness under a stream of nitrogen. The residual solid was recrystallized from n-hexane to yield 1-azido-8-trifluoracetamidonaphthalene in the form of light yellow needles in a yield of 215 mg., 77 percent, m.p. 102°C.–103°C. and an analysis of: Calcd: C, 51.50; H, 2.50; N, 20.50; F, 2070 Found: C, 51.75; H, 2.37; N, 19.74; F, 20.07

EXAMPLE 5

Preparation of 1-Azido-8-Hydroxynaphthalene

A sample of 8-azido-1-naphthylamine (0.368 g., 0.02 mole) was dissolved in warm, dilute sulfuric acid (3 ml. of conc. $H_2SO_4$ diluted with 30 ml. of water). The solution was cooled to O°C. and diazotized with a solution of $NaNO_2$ (160 mg., 0.023 mole) in 2 ml. of water. The excess of nitrous acid was destroyed by the addition of urea. The yellow solution of the diazonium salt was diluted with 100 ml. of water and heated at 60°for 1.5 hr. The precipitated material was washed with water, dried and filtered through activated charcoal. Removal of ether left a residue which weighed 35 mg. Recrystallization from petroleum ether gave 1-azido-8-hydroxynaphthalene in the form of pale yellow needles (20 mg., 5.4 percent), m.p. 65°C.–67°C.

EXAMPLE 6

1,8-diazidonaphthalene Photosensitive Composition

A stock solution of polyvinylchloride (PVC) was prepared by combining 20 g. of PVC powder (Geon 101 by B. F. stirring the resulting mixture at 60°C. overnight. A 0.7N solution of 1,8-diazidonaphthalene was prepared by adding 1.0 g. of the azido compound to the cooled polymer solution. After stirring for a period of about 2 hours, the resulting solution was applied to 32 lb. white paper in the form of a film having a thickness in the range of about 0.2 mil. to about 0.3 mil. Uniform distribution of the polmer solution on the paper was effected by the Mayer rod technique. The coated paper was dried in the dark at room temperature overnight.

EXAMPLE 7

1,8-Diazidonaphthalene Photoimaging Process

The photosensitive composition of Example 6 was placed over a negative transparency having both printed material for sharp line contrasts and a photograph for continuous tonal variations, and the pair were placed upon the lens of a bank of blacklight blue fluorescent lamps for a period of 30 seconds, producing a grey-green positive reproduction of the negative image.

EXAMPLE 8

Thermal Image Enhancement and Fixing of 1,8-Diazidonaphthalene Image

The photoimage of Example 7 was fixed by passing it over a heated drum while passing hot air (both from 135°C. to 155°C.) over its surface for about 30 seconds. A deep purple image having very high resolution and excellent quality of tonal range was produced. The substantially colorless background was stable to fogging upon prolonged exposure to sunlight.

EXAMPLES 9–10

Thermal Image Modification of Fixed 1,8-Diazidonaphthalene Image

The fixed photoimage of Example 8 was heated for an of from about 180°C. to about 190°C., producing a grey-black image having very high resolution and excellent quality tonal range.

Substantially the same result was produced by heating a photoimage prepared by the procedure of Example 7 at a temperature in the range of from about 180°C. to about 190°C. for a period of about 5 minutes.

EXAMPLE 11

Ultraviolet Image Modification of Fixed 1,8-Diazidonaphthalene Image

A fixed photoimage prepared by the procedure of Example 8 was re-exposed to the light from a high pressure, 1000 watt mercury lamp (B-H6 General Electric Company) for a period of about 5 minutes. A charcoal-grey positive image having very high resolution and excellent quality tonal range was produced.

EXAMPLE 12

Photoimaging with 1-Acetamido-8-Azidonaphthalene (AcAN)

By the general procedure of Example 6, photosensitive compositions of AcAN were prepared by dissolving 66.8 mg. of AcAN in 3 ml. of a PVC stock coating solution. The coating solution was prepared by dissolving 7.0 g. of PVC (Geon 101) in 100 ml. of tetrahydrofuran.

The composition was imaged by the general procedure of Example 7. The grey-brown image produced was developed to a partially fixed deep purple image by heating at 130°C.–155°C. The fixed image was modified to neutral tones by heating at 180°C. for about 4 minutes.

EXAMPLE 13

Photoimaging with 1-Azido-8-Trifluoroacetamidonaphthalene (ATN)

The procedure of Example 12 was substantially reimage was light brown. Development produced a deep purple image which formed a neutral image on thermal modification.

EXAMPLE 14

Photoimaging with 1-Azido-18-Hydroxynaphthalene (AHN)

The procedure of Example 12 was substantially repeated using 37.0 mg. of AHN in place of the AcAN and using 2 ml. of the stock solution.

The initial image was light grey in color. Heating at 130°C.-140°C. for about 4 minutes produced an intensified image of neutral shade.

EXAMPLE 15

Photoimaging with 1-Amino-8-Azidonaphthalene (AAN)

The procedure of Example 12 was substantiall repeated using a coating composition prepared by dissolving 40 mg. of 1-amino-8-azidonaphthalene in 4 ml. of a stock PVC solution. The stock solution was prepared dissolving 400 mg. of PVC (Geon 101) in 4 ml. of tetrahydrofuran. The initially formed image was light brown in color. A deep purple, fixed image was produced by heating at 140°C.-150°C. for about 5 minutes. Heating to 190°C. for about 5 minutes produced an image having neutral tones.

EXAMPLE 16

Sensitized Photoimaging with 1,8-Diazidonaphthalene

A stock solution of polyvinyl chloride was prepared by combining 100 g. of PVC powder (Geon 101) with 1000 ml. of THF and stirring for 24 hours at room temperature. A sample of the resulting polymer dope was made 0.67N in 1,8-diazidonaphthalene and 0.5N in perylene. The normalities are relative to the dried binder. The sensitized polymer mixture was uniformly distributed over the surface of a Mylar polyester film by means of a fixed blade. The blade was adjusted to produce a binder layer having a thickness of $8.4 \times 10^{-4}$ cm. The coated film was dried in the dark at room temperature overnight. The dried film was exposed to a light source emitting at 405 m$\mu$ through a transparency for various periods ranging from about 10 seconds to about 100. The exposed film was heated at 135°C. for 10 minutes to produce a fixed purple image with a yellow background.

The initial rate of color formation (R) for the sensitized system was obtained by determining the initial slope of the curve formed by plotting the optical density of each film, measured at 545 m$\mu$, against the exposure time.

The efficiency of the sensitized system is expressed in alternative manners. Firstly, it is expressed as the ratio of R for the sensitized system ($R_s$) over the corresponding value for the unsensitized system with excitation at the same wavelength ($R_u$). Secondly, it is expressed as the ratio of $R_s$ over the corresponding value for the unsensitized system with direct excitation at 320 m$\mu$ ($R_{ud}$). The values observed are as follows: $R_s/R_u$ = 26.0; $R_s/R_{ud} = 0.53$.

Further heating or UV re-exposure of the fixed image produces image modification as described in Examples 9 and 10.

EXAMPLE 17

Employing the general procedure of Example 16 using a polymer dope which has 1.2N in thioacridone in substitution for the perylene used therein, and using an excitation frequency of 470 m$\mu$ is substituted for the 405 m$\mu$ light used therein, a purple image with an orange background was obtained with the following efficiency: $R_s/R_u$ = OO; $R_s/R_{ud} = 0.09$.

Further heating or UV re-exposure of the fixed image produces image modification as described in Examples 10 and 11.

I claim:

1. A dry imaging process comprising the consecutive steps of:

a. imaging a light sensitive material comprising a suitable photographic substrate having a coating deposited thereon, said coating consisting essentially of a permeable film-forming plastic having a photosensitive, volatile, peri-substituted naphthalene azido compound dispersed therein wherein the azido compound has one of the following substituents oriented peri to the azido group: amino, hydroxy azido, trifluoroacetamido, or

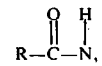

wherein R is lower alkyl having from $C_1$–$C_6$ or phenyl by irradiating with patterned activating radiation to produce a visible image; and heating the material to evaporate the unreacted naphthalene azido compound.

2. A dry imaging process according to claim 1 wherein the radiation is ultraviolet light.

3. A dry imaging process according to claim 1 wherein the photosensitive material is heated to a temperature in the range of from about 100°C. to about 150°C.

4. A dry imaging process according to claim 1 employing a photosensitive material wherein the azido compound is 1,8-diazidonaphthalene, 1-acetamido-8-azidonaphthalene, 1-azido-8-trifluoracetamidoaphthalene, 1-amino-8-azidonaphthalene or 1-azido-8-hydroxynaphthalene and further comprising a step of modifying the image to more neutral tones by heating.

5. A dry imaging process according to claim 3 wherein the azido compound is 1,8-diazidonaphthalene, and the coating is polyvinyl chloride having from about 3 to about 15 percent by weight of the azido compound and a thickness of from about 0.05 mils to about 1.00 mils, further comprising a step of modifying the image to more neutral tones by exposure to ultraviolet light.

6. A dry imaging process according to claim 1 with the photosensitive material further comprising a sensitizer of ultraviolet or visible light sensitizers with the coating, wherein the radiation is visible light or a mixture of visible and ultraviolet light.

7. A dry imaging process according to claim 6 comprising the consecutive steps of:

a. imaging a material wherein the sensitizer is a volatile, visible light sensitizer by irradiating with a patterned mixture of visible and ultraviolet light; and b. fixing the imaged material by heating to volatilize the unirradiated azido compound and the visible light sensitizer.

8. A dry imaging process according to claim 1 wherein the sensitizer is a visible light sensitizer and the activating radiation is visible light.

9. A dry imaging process according to claim 7 wherein the azido compound is 1,8-diazidonaphthalene and the sensitizer is fluorenone or benzanthrone.

* * * * *